US008069946B1

(12) United States Patent
Cruise, III

(10) Patent No.: US 8,069,946 B1
(45) Date of Patent: Dec. 6, 2011

(54) PORTABLE SOUND RECORDING DEVICE

(76) Inventor: Martin Howard Cruise, III, Parkville, MD (US)

( * ) Notice: Subject to any disclaimer, the term of this patent is extended or adjusted under 35 U.S.C. 154(b) by 0 days.

(21) Appl. No.: 12/894,028

(22) Filed: Sep. 29, 2010

(51) Int. Cl.
*A47B 81/06* (2006.01)

(52) U.S. Cl. ..... 181/198; 381/354

(58) Field of Classification Search ..... 181/198; 381/354
See application file for complete search history.

(56) References Cited

U.S. PATENT DOCUMENTS

| | | | | |
|---|---|---|---|---|
| 2,618,191 | A | 11/1952 | Martin | |
| 2,897,034 | A * | 7/1959 | Kalen | 312/327 |
| 3,083,417 | A * | 4/1963 | Cook | 52/64 |
| 3,555,956 | A | 1/1971 | Martin | |
| D242,634 | S | 12/1976 | Timm | |
| 4,226,162 | A | 10/1980 | Ebach | |
| 4,366,882 | A * | 1/1983 | Parker | 181/30 |
| 4,515,238 | A * | 5/1985 | Baker | 181/30 |
| 4,658,932 | A | 4/1987 | Billingsley | |
| 4,805,728 | A | 2/1989 | Carter et al. | |
| 4,967,874 | A | 11/1990 | Scalli | |
| 5,123,874 | A * | 6/1992 | White, III | 454/251 |
| 5,463,925 | A * | 11/1995 | Galocy | 84/423 R |
| 6,434,240 | B1 * | 8/2002 | Kulas | 381/89 |
| 7,451,855 | B2 | 11/2008 | Wang | |
| 7,783,069 | B1 * | 8/2010 | Miller et al. | 381/354 |

* cited by examiner

*Primary Examiner* — Forrest M Phillips
(74) *Attorney, Agent, or Firm* — The Law Firm of Andrea Hence Evans, LLC

(57) ABSTRACT

A portable sound recording device and method comprises a first enclosure having symmetrical halves and a second enclosure having symmetrical halves. The second enclosure is fitted inside the first enclosure such that neither enclosure has direct contact with each other. The symmetrical halves pivot about the device handle. A sound resistant material aligns the inside walls of the second enclosure and the outside walls of the second enclosure. The device eliminates unwanted echoes and allows sound to be clearly captured by an attached microphone or input device.

12 Claims, 10 Drawing Sheets

PORTABLE SOUND RECORDING DEVICE

FIELD OF THE INVENTION

The present invention relates in general to a portable device having an enclosure with a sound barrier material and more particularly the device provides a quality recording without the user being confined to a particular room.

BACKGROUND OF THE INVENTION

Songs and parts of songs such as the lyrics or beats are typically recorded at a professional recording studio. The artists are likely to have to travel to the professional studio, at the request of the producer. To cut costs, many artists build home studios; however, the sound quality is often compromised due to large amounts of noise bleeding in or out the room. Most home studios are not conducive to recording or monitoring audio. They are often small causing the recorded sound to be uneven. Wall and ceiling treatments may be added to home studios to reduce bad sound effects but these treatments are difficult to install, expensive, and the treatments often require professional installation in order to work properly.

Additional recording studio issues also include handling noise leaking into the studio, noise leaking out of the studio (and bothering your neighbors), electrical power distribution to and within the home studio, grounding for the equipment within your studio, where to get good audio cables and how best to use them in the studio, and many other important issues.

SUMMARY OF THE INVENTION

This invention introduces a device that allows anyone with recording capabilities to turn any reasonably quiet room into a sound dampened room by capturing sound in a localized enclosure that eliminates unwanted echoes and allows the sound to be clearly captured by an attached microphone.

An aspect of an embodiment of the invention provides a portable sound resistant enclosure that can also house recording equipment.

A further aspect of an embodiment of the invention provides sound dampening foam positioned in the enclosure which aids in achieving a professional quality recording.

Additional aspects, objectives, features and advantages of the present invention will become apparent from the following description of the preferred embodiments with reference to the attached drawings.

DETAILED DESCRIPTION OF THE INVENTION

Figure 1:
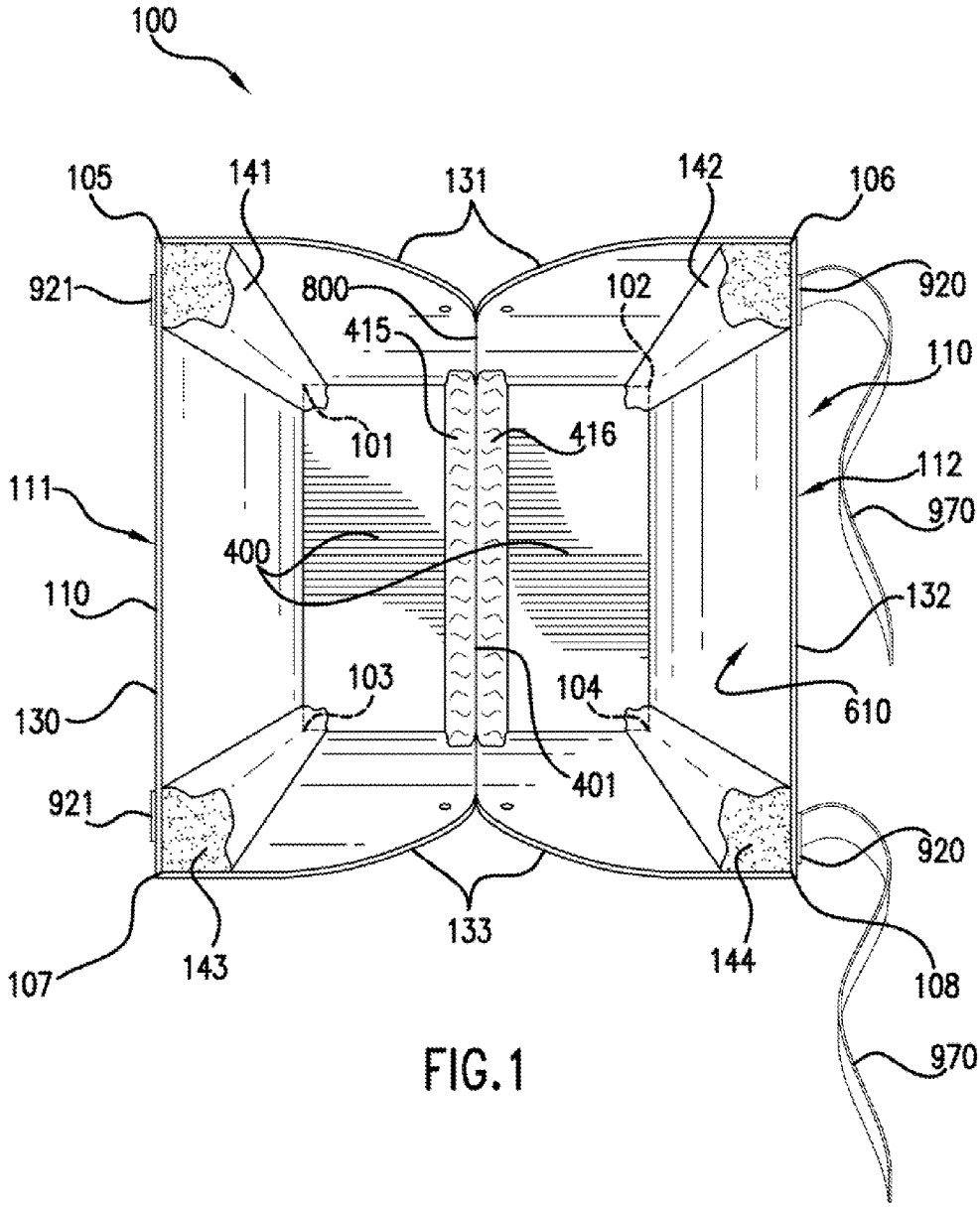
FIG. 1 illustrates a first enclosure of the portable sound recording device.

FIG. 1 illustrates a first enclosure 110 of the portable sound recording device 100. The device 100 features a first enclosure 110 having a first half 111 and second half 112. The first enclosure may be a box with dimensions of at least one cubic foot. The first enclosure 100 comprises four inside corners 101, 102, 103, and 104. The inside corners 101-104 are the four corners inside of the box located between each wall on the enclosure where the walls make a 90 degree angle. The first enclosure also features four outside edges 105, 106, 107, and 108. The outside edges 105-108 are located at the corners of the enclosure 100 parallel to the inside corners. The enclosure features four walls 131, 132, 133 and 134. Inside corner 101 is located inside enclosure 100 at a corner where wall 131 joins 130. Inside corner 102 is located inside enclosure 100 at a corner where wall 131 joins wall 132. Inside corner 104 is located inside enclosure 100 at a corner where wall 132 joins 133. Inside corner 103 is located inside enclosure 100 at a corner where wall 133 joins wall 130. Corners 101 and 103 are located inside the first half 111 and corners 102 and 104 and edges 106 and 108 are located inside the second half 112. Sound resistant material in the form of strips are secured to the first enclosure 100 between inside corners 101-105 and their respective edges 105-107. Strip 141 extends between corner 101 and edge 105. Strip 142 extends between corner 102 and edge 106. Strip 143 extends between corner 103 and edge 107. Strip 144 extends between edge 104 and corner 108. The strip is a sound dampening foam that creates actual sound barriers that absorb sound just like in a studio therefore providing the user with the optimal high performance results. However, other known sound dampening materials may be substituted. The strip may be a sound dampening foam of dimensions of at least 1 in×1 in×1.5 in at all inside corners.

Figure 4:
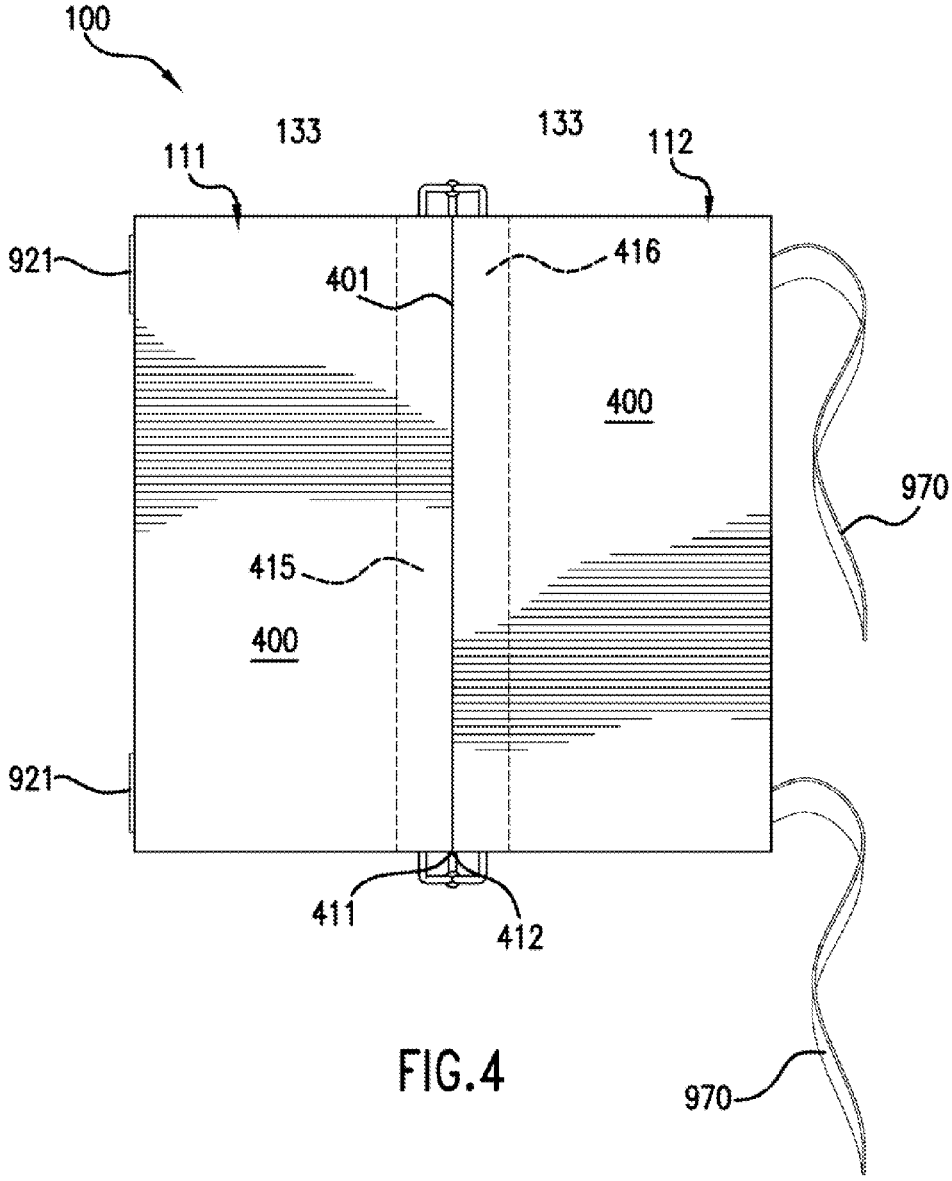
FIG. 4 is a front view of the portable sound recording device in a closed position.

The first enclosure 100 also features a base 400 shown in FIG. 4. FIG. 4 is a front view of the portable sound recording device 100 in a closed position. The first enclosure is divided in half at a cut line 401 creating two identical and symmetrical halves 111, 112. The device 100 is in a closed position when half 111 is moved towards half 112 such that the half base edge 411 makes contact with half base edge 412. The device 100 opens and closes along the cut line 401. Sound dampening strips 415, 416 are positioned along either side of the dividing cut line 401 on the inside of the first enclosure 110. The cut line 401 is a plane perpendicular to the plane of the open end of the device 100 going through the midpoint of two parallel sides of the device 100.

Figure 2:
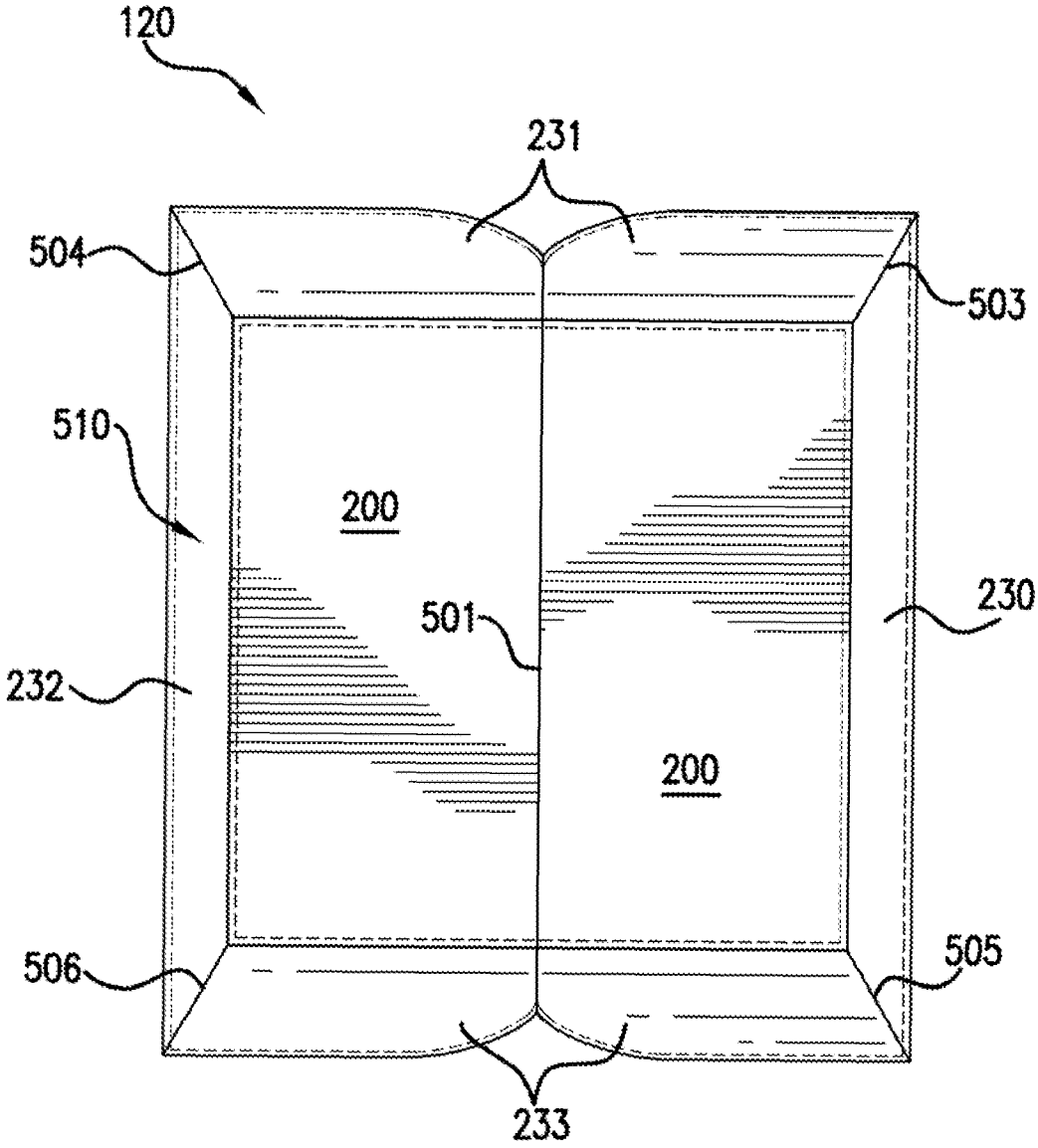
FIG. 2 illustrates a second enclosure of the portable sound recording device. back view of the portable sound recording device in a closed position.

FIG. 2 illustrates the second enclosure 120 of the portable sound recording device 100. The second enclosure 120 is smaller than the first enclosure 110. The second enclosure 120 is a smaller rigidly reinforced box that may be at least 10 inches cubed. The second enclosure 120 features four walls 230, 231, 232 and 233. The second enclosure also features a base 200. Similar to the first enclosure 110, the base 200 of the second enclosure 120 is divided in half at a cut line 501 creating two identical and symmetrical halves 211, 212.

Figure 3:
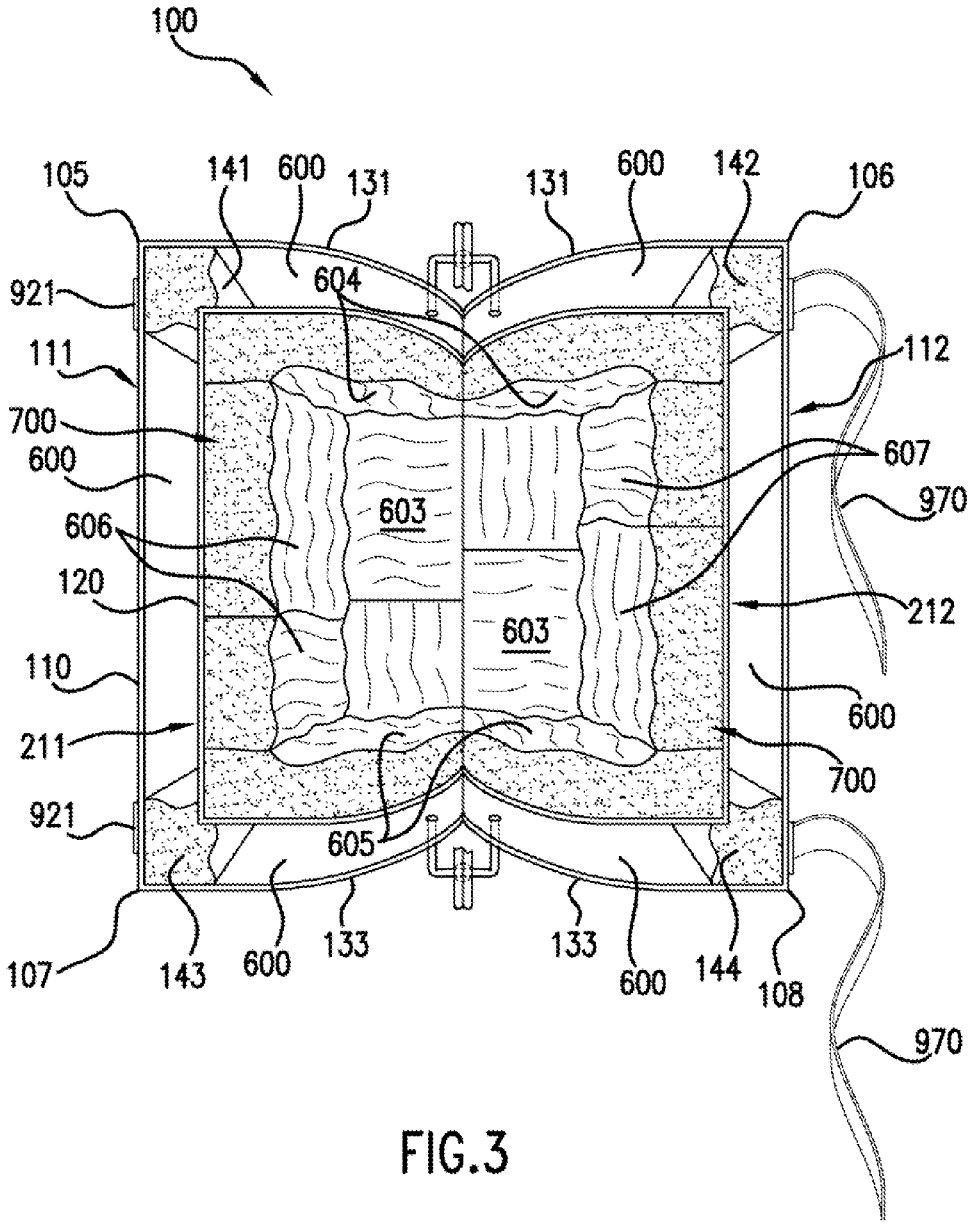
FIG. 3 is a perspective view of the second enclosure positioned inside the first enclosure.

FIG. 3 is a perspective view of the second enclosure 120 positioned inside the first enclosure 110. The second enclosure 120 features outside edges 503, 504, 505, and 506. The outside edges 503-506 are located on an outer surface 510 of the second enclosure 120. Wall 230 and 231 join at edge 503. Wall 232 and 231 join at edge 504. Wall 233 and wall 230 join at edge 505. Wall 232 and 233 join at edge 506. Second enclosure 120 is positioned inside of the first enclosure 110. The edges 503-506 are attached to the sound dampening strips 141-144, respectively. Specifically, edge 503 is attached to strip 141, edge 504 is attached to strip 142, edge 505 is attached to strip 143 and edge 506 is attached to strip 144. The second enclosure 120 floats inside of the first enclosure 110. The second enclosure 120 surface 510 does not make any direct contact with the inside surface 610 of the first enclosure 110. Sound dampening strips 141-144 and 415, 416 are positioned between the first enclosure 110 and second enclosure 120. The area between the first enclosure 110 and second enclosure 120 that does not feature strips 141-144 and 415-16 form an open space 600 filled with air. The open space 600 serves as a bass trap. The space 600 is an acoustic absorber or sound baffle which has the ability to capture low frequency sound. A sound resistant material 700 is attached to the inside walls of the second enclosure 120. The inside walls are the inside base 603, side walls 606, 607, top wall 604 and bottom wall 605 which are located on the interior of the second enclosure 120. The sound resistant material 700 may be sound dampening foam with at least 1 inch thickness. The material 700 covers the interior of the second enclosure 120 on both halves 211, 212 and the material is attached in alternating patterns such that the material 700 on the inside walls of half 211 is a mirror image of the material 700 on the inside walls of half 212.

Figure 5:
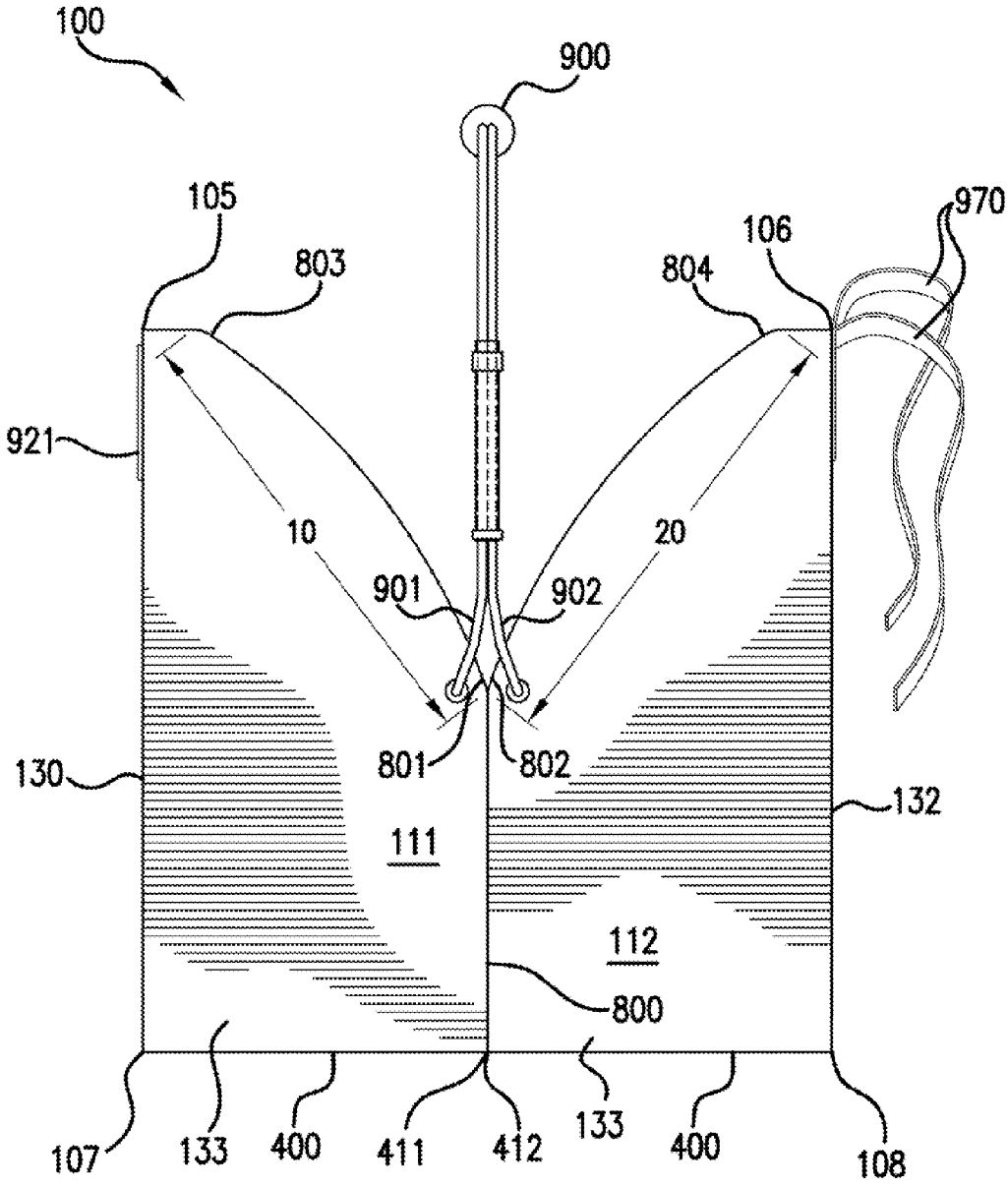
FIG. 5 is a perspective view of the portable sound recording device placed on its front side in a closed position.

FIG. 5 is a perspective view of the portable sound recording device 100 placed on its front side in a closed position. The base 400 of the device 100 is its front side. The first enclosure 110 features a second cut line 800 which extends from edge 411 upward along wall 133 to a first angled top edge 801 such that the first half 111 is separated from the second half 112 along cut lines 800 and 401. The first half 111 remains symmetrical to half 112 because the first enclosure is cut from edge 412 upward along wall 133 to a second angled top edge 802 on the second half 112. The second enclosure 120 is a smaller version of the first enclosure 110 such that it also features a second cut line extending from the cut line 501 upward along its walls. The device 100 is cut in half or divided in half by a plane perpendicular to the plane of the open end of the device going through the midpoint of two parallel sides of the device. Two symmetrical mirror imaged halves are created such that connected halves 112 and 212 are symmetrical and mirror image to connected halves 111 and 211. A cut is made from the first angled top edge 801 to an upper top edge 803 so that the top portion of wall 133 is angled at about 45 degrees. The same cut is made from the second angled top edge 802 to the upper second top edge 804 such that the wall is angled at about a 45 degree angle. The same angled cut is made on the opposite wall 131 and on second enclosure walls 231 and 233. The portion of the enclosure 110 between angled top edge 801 and upper top edge 803 and second angled top edge 802 and upper second top edge 804 form a V-shape. A V-shape is also formed on the opposite edges of the first enclosure on wall 131 and also on walls 231 and 233 of the second enclosure 120.

Figure 6:
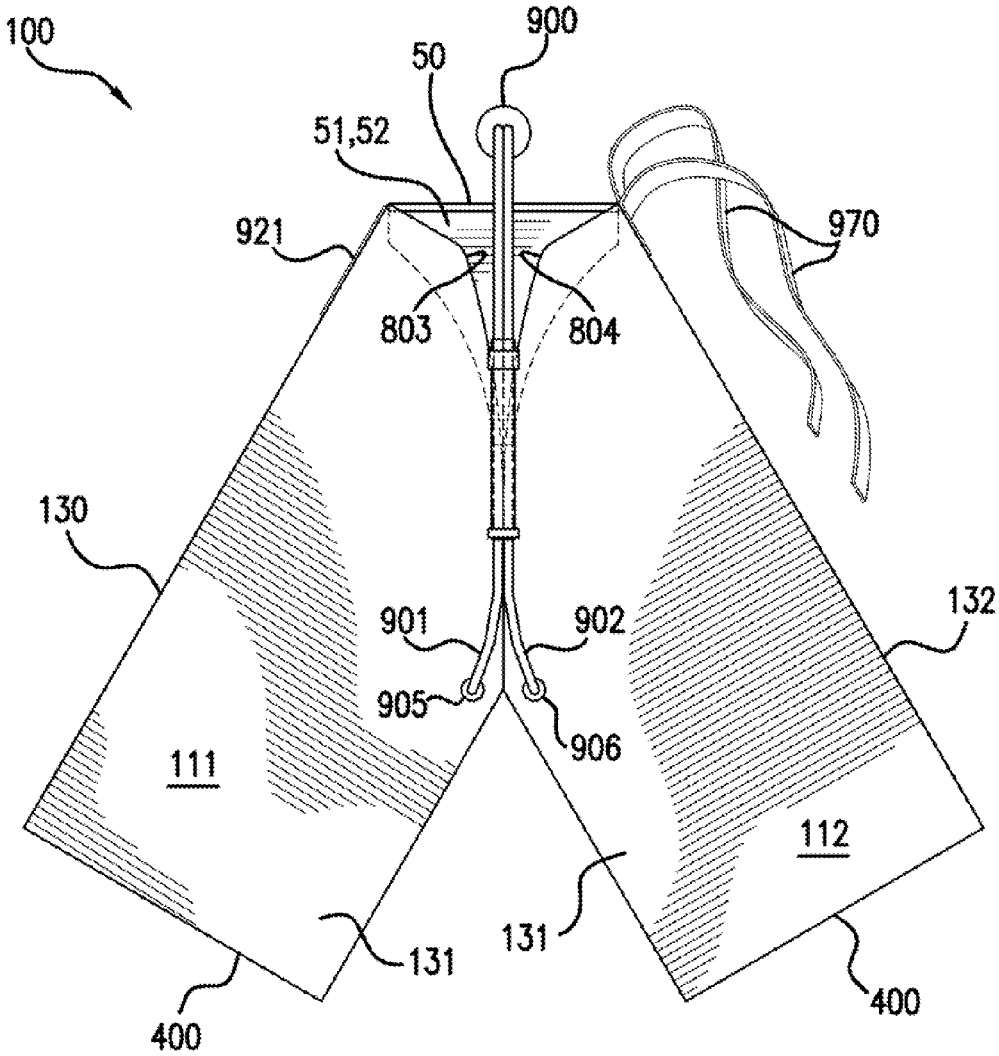
FIG. 6 is a top view of the portable sound recording device in an open position.

FIG. 6 is a top view of the portable sound recording device 100 in an open position. The device 100 further comprises a handle 900 having a first leg 901 connected to the first half 111 and a second leg 902 connected to the second half 112. The first leg 901 is inserted into an aperture 905 on the first half 111 and the second leg 902 is inserted into an aperture 906 on the second half 907. The apertures 905 and 906 are positioned on wall 133 of the first enclosure 110. Symmetrical and identical apertures are positioned on wall 131 of the first enclosure to receive the third and fourth legs of the handle 900. The halves 111 and 112 are connected together near the inner vertex of the cut 800 with the corner bracket or handle 900. The corner bracket/handle 900 is in the same plane as the cut 800 and along the open side of the device. The corner bracket/handle 900 features two 0.25 inch diameter aluminum rods of length 27 inches, machined into a C-shape of dimension: 13 inches long in the middle, two 4.5 inch long sections extended perpendicularly from the each end of the 13 inch section and two 2 inch long sections extending perpendicularly from each end of the 4.5 inch sections. The corner bracket connects to and together the first enclosure halves 111 and 112 and connected second enclosure halves 211 and 212 by inserting the 2 inch long sections of the C rods into predrilled holes or apertures 901, 902 and two additional apertures (not shown). The apertures are positioned one on each side of the first enclosure halves 111, 112 near the vertex of the cut 800. There are four holes/apertures total. The legs 901, 902 are capped into place once inserted through their respective apertures. The first enclosure 110 and second enclosure 120 are both reinforced at the corner bracket/handle connections which are the points where the leg is inserted inside the aperture to prevent shear. The handle 900 may be adjustable such that its height can be adjusted. The handle 900 may collapse to rest along a top surface of cover or lid 910 which can be placed over the open inside area of the connected first and second enclosure during transit or when the device is not in use.

Figure 7:
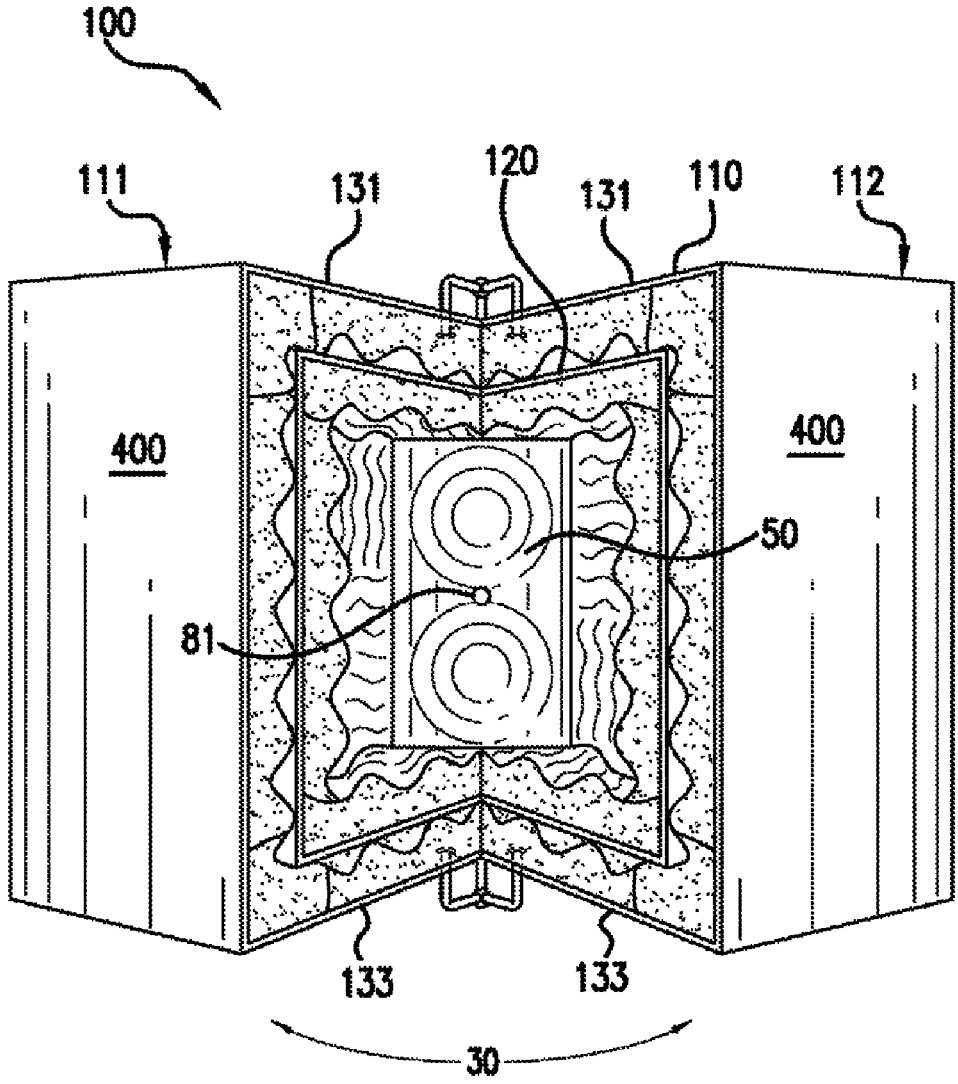
FIG. 7 is a front view of the portable sound recording device in an open position.

The first half 111 and second half 112 pivot around their respective handle legs 901, 902 to move the device 100 into an open and closed position. The first and second angled top edges 803, 804 make contact when the halves 111 and 112 are pivoted. The portion 10 of the first enclosure 110 between the first angled top edge 801 to an upper top edge 803 and the portion 20 between the second angled top edge 802 and upper second top edge 804 act as a rail such that the halves 111 and 112 are moved in a direction 30 along portions 20 and 30 until first enclosure walls 130 and 132 make flush contact with flange 50. When the walls 130 and 132 make flush contact with flange 50, the device 100 is in a functional and open position and ready to use. Similarly, portions on wall 131 act as a rail in an identical location on the wall as discussed for wall 133 since the device is symmetrical. FIG. 7 is a front view of the portable sound recording device 100 in an open position.

Figure 8:
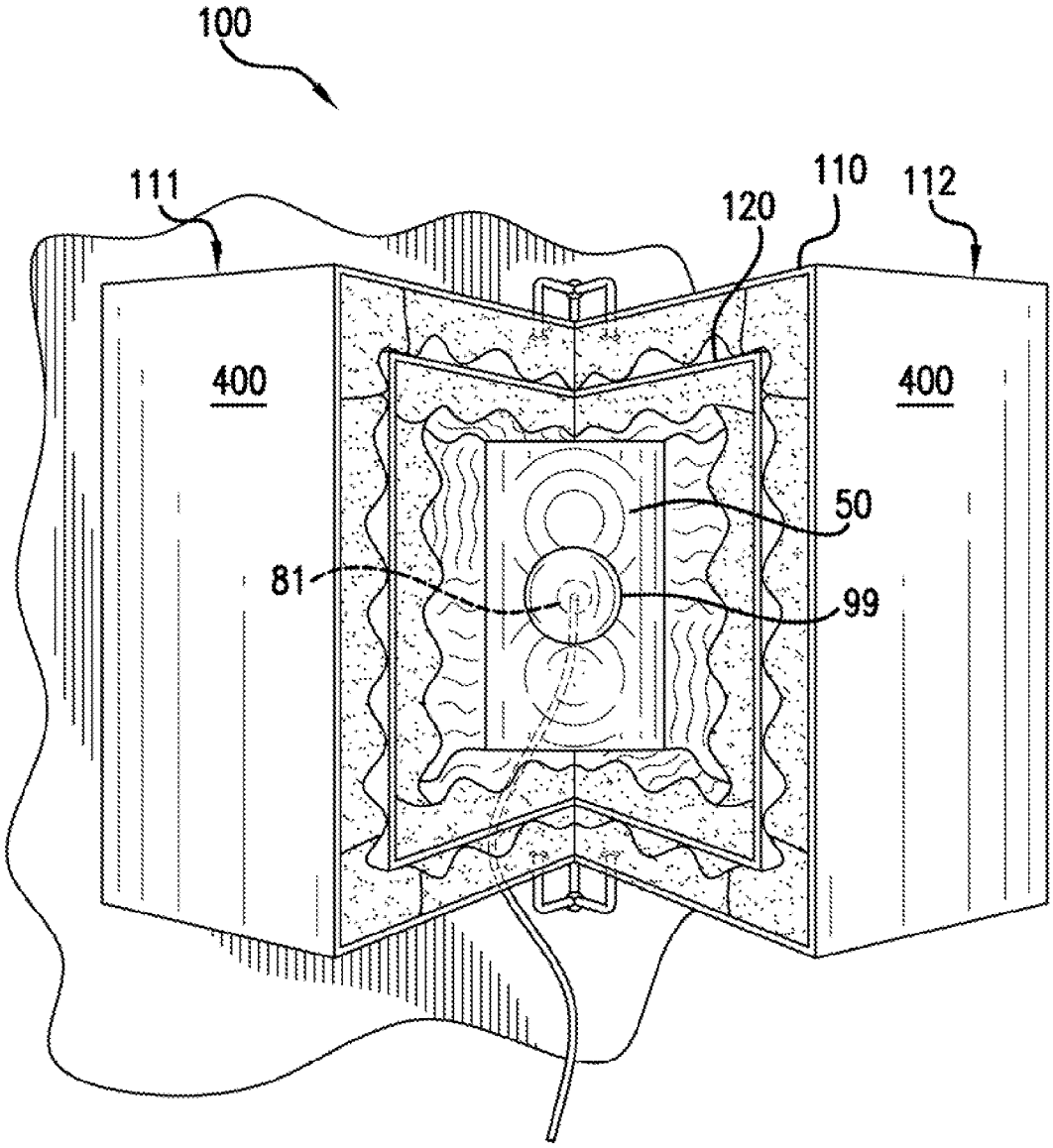
FIG. 8 is a front view of the portable sound recording device in an open position with an attached input device.

FIG. 8 is a front view of the portable sound recording device 100 in an open position with an attached input device 99. Flange 50 has a circular opening 81 located in the center which acts as an attachment mechanism for input devices 99. Once an input device, such as a microphone 99, is placed in the opening 81 of the rectangular flange 50 and connected to a power/recording source, the device 100 is ready for use in any mostly quite room with the user doubling as a movable baffle. The cord of the input device 99 is inserted through the opening 81 such that the power source, recording source or output device can easily be connected to the device 99. During transport or when the device is in a closed position, the device houses recording equipment (i.e. microphone, headphones, USB storage, and audio studio cd) inside of the interior of the second enclosure 120. The device 100 is lightweight and small in size and can be carried by most people with at least the strength of a young child.

Figure 10:
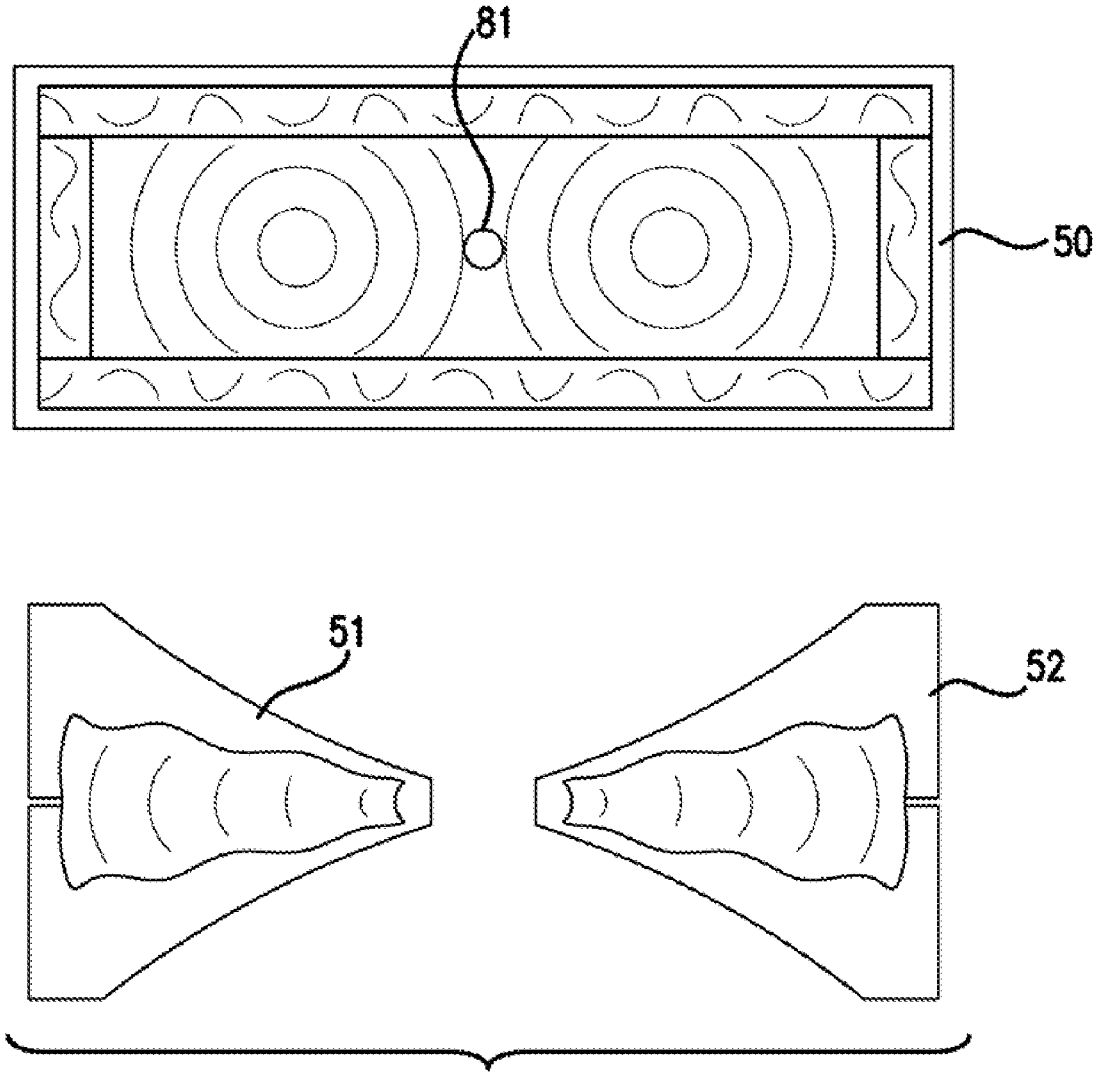
FIG. 10 illustrates sectional pieces of the portable sound recording device.

FIG. 10 illustrates sectional pieces of the portable sound recording device. Two triangular flanges 51, 52 are made using the section of material cut from the 45 degree cut. This is the material removed when the portion of the enclosure 110 between angled top edge 801 and upper top edge 803 and second angled top edge 802 and upper second top edge 804 were cut to form a V-shape. This is also the material removed from wall 131 which is the identical size, shape and cut in the same position as the cut described for wall 133. The triangular flanges 51, 52 are lined with two inches of sound dampening foam 700 substantially near the center of the triangle. A rectangular flange 50 having an approximate length one foot is lined with at least a two inch thick layer of sound dampening foam 700 and contains a circular opening 81 in the center for placement of an input device 99. Flanges 51 and 52 are placed parallel and flush with walls 133 and 131 of the device to fill in the voids 801-804 left by closing the original open side. Flange 50 shall be positioned so that its length edges connect walls 130 and 132 and its width edges connect 50 and 51 when device 100 is in an open state. The width of the flanges 50-52 are trimmed to fit into the device 100.

Figure 9:
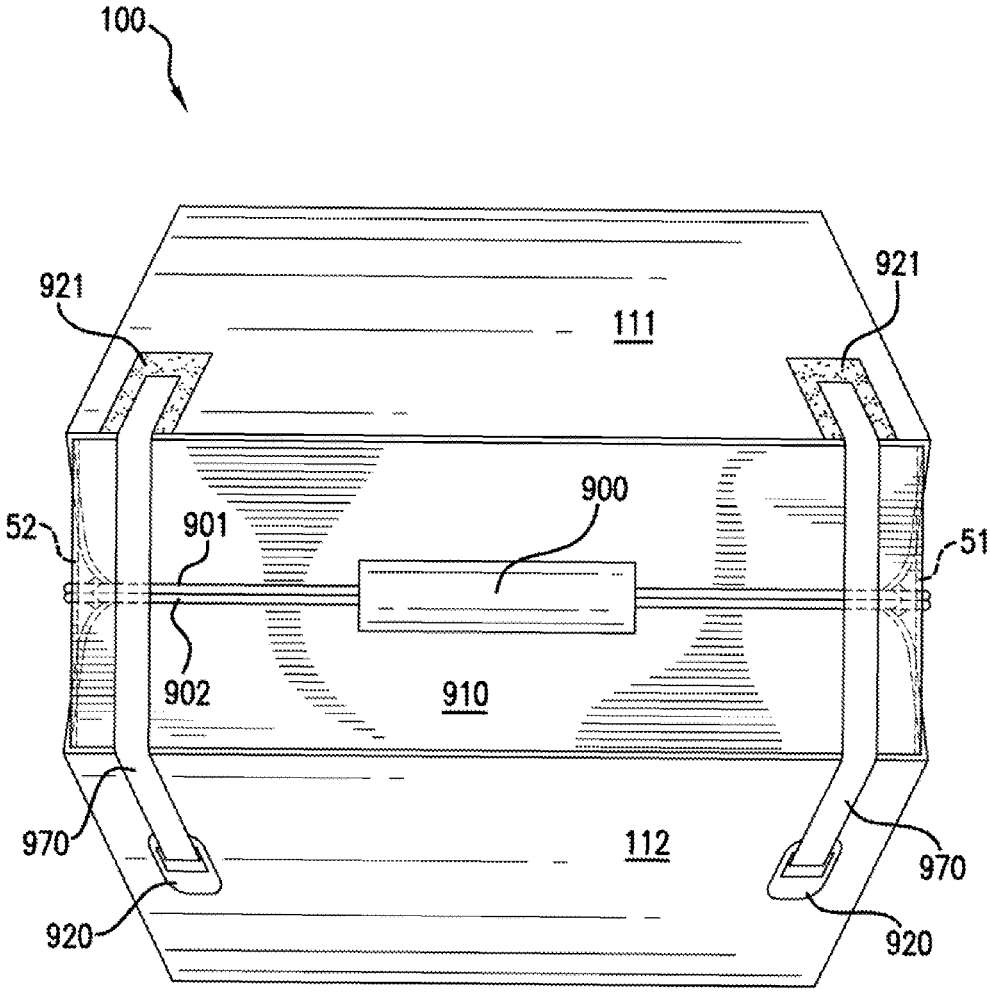
FIG. 9 is a top view of the portable sound recording device in its transportable state.

FIG. 9 is a top view of the portable sound recording device in its transportable state. The device 100 is shown in a closed state having a lid 910 covering the interior of the first and second enclosures 110, 120. The lid 910 extends across the tops of the first and second halves 111, 112 and downward to cover the V-shaped opening on the device. Brackets 920, 930 are secured to the second half 112 outer surface. The brackets 920, 930 have straps 970 extending from the brackets 920, 930. The straps 970 may be Velcro straps. The straps 970 have a length that affords the straps the ability to extend across the top opening of the device to the opposite half 111. The outer surface of the first half 111 features an a strap attachment mechanism 921 which secures the strap to the first half 111. The strap attachment mechanism may be a Velcro attachment that will allow the strap 970 to easily remain secure to the device. When the lid 910 is on the device 100, the straps 970 will be used to keep the device closed and prevent contents from falling out. Or, the Velcro straps 970 may be used to extend along the back of the device and connect to the attachment mechanism to aid in keeping the device 100 in an open position.

The device 100 is portable and easy to use. The user will receive the device in a closed state having the necessary equipment requested or required and the rectangular and triangular flanges 50-52. The flanges 50-52 will be removed from the device and positioned so that flanges 51 and 52 lay parallel and flush with walls 131 and 133 and fill in voids 801-804 when device is in an open state, as shown in FIG. 6. Flange 50 shall be positioned so that its length edges connect walls 130 and 132 and its width edges connect 50 and 51 when device is in an open state. The halves 111, 112 will be moved such that they pivot around the handle to move the device to an open state. The strap 970 will extend around the outer walls and across the flush walls 130, 132 to the strap attachment. An input device 99 such as a microphone is attached to the second enclosure 112 through a circular opening 81 located in the center of 50. The microphone 99 is connected to its power source and the device is ready for functional use. The user can put on headphones, press record and speak into the device opening opposite where the microphone is attached. The recorders' head and body acts as the fourth corner creating a movable baffle and a virtual four cornered sound dampened room. When the user speaks into the microphone and if the microphone is connected to a recording source, a professional quality recording can be achieved.

The invention has been described in detail with particular reference to certain preferred embodiments thereof, but it will be understood that variations and modifications can be effected within the spirit and scope of the invention.

The invention claimed is:

1. A portable sound recording device comprising:

a first enclosure having a first half and second half, wherein the first and second halves comprise inside corners each having a sound resistant strip;

a second enclosure inside of the first enclosure, wherein the second enclosure makes contact with the sound resistant strip;

wherein the first enclosure further comprises a first angled top edge on the first half and a second angled top edge on the second half, wherein the first and second angled top edges abut when the halves are pivoted;

a space between an inside portion of the first enclosure and an outside portion of the second enclosure trapping bass; and a sound resistant material on inside walls of the second enclosure.

2. The portable sound recording device of claim 1 further comprising a handle having a first leg connected to the first half and a second leg connected to the second half, wherein the first half and second halves pivot around their respective handle legs.

3. The portable sound recording device of claim 1 wherein the first half has an outer portion having an attached strap which mates with a strap attachment on an outer portion of the second half.

4. The portable sound recording device of claim 1, wherein the second enclosure further comprises an attachment mechanism which can attach to equipment.

5. A portable sound recording device comprising:

a first enclosure divided in a first and a second symmetrical half along a first cut line; wherein the first enclosure has an inside portion;

a second enclosure divided in a third and a fourth symmetrical half along a second cut line, wherein the second enclosure is positioned in the inside portion of the first enclosure such that the first cut line is coincident with the second cut line;

a sound resistant material attached to inner walls of the second enclosure;

and a collapsible handle.

6. The portable sound recording device of claim 5 further comprising the sound resistant material between outer walls of the second enclosure and inner walls of the first enclosure.

7. The portable sound recording device of claim 5 wherein the handle connects the first enclosure to the second enclosure.

8. The portable sound recording device of claim 6, wherein the first symmetrical half further comprise a first and second wall, wherein the first wall has a first wall angle extending from a top of the first cut line to a top of the first wall and the second wall has a second wall angle extending from a bottom of the first cut line to a top of the second wall.

9. The portable sound recording device of claim 8, wherein the second symmetrical half further comprise a third and fourth wall, wherein the third wall has a third wall angle extending from a top of the first cut line to a top of the third wall and the fourth wall has a fourth wall angle extending from a bottom of the first cut line to a top of the third wall.

10. The portable sound recording device of claim 9, wherein the third and fourth symmetrical halves further comprise third symmetrical half top and bottom walls and a fourth symmetrical half top and bottom walls having angles extending from the second cut line to a top and bottom of the third symmetrical half top and bottom walls and the fourth symmetrical half top and bottom walls.

11. A method of creating a portable studio comprising:

providing a first enclosure having a first and second half, wherein the first enclosure has a first enclosure inside surface;

providing a second enclosure positioned inside the first enclosure, wherein the second enclosure has a second enclosure outside surface and a second enclosure inside surface, providing sound resistant material between the first enclosure inside surface and the second enclosure outside surface, whereby the second enclosure floats inside of the first enclosure;

providing a space between the first enclosure and second enclosure to trap bass;

connecting a handle to the first and second half;

pivoting the first and second half about the handle to an open position;

positioning an input device in the inside surface of the second enclosure; whereby a sound can be received by the input device and recorded.

12. The method of claim 11 further comprising providing the first and second enclosure surfaces do not make contact.

* * * * *